US009679737B2

(12) United States Patent
Heid et al.

(10) Patent No.: US 9,679,737 B2
(45) Date of Patent: Jun. 13, 2017

(54) SPARK GAP

(75) Inventors: Oliver Heid, Erlangen (DE); Timothy Hughes, Erlangen (DE); Jennifer Sirtl, Fürth (DE)

(73) Assignee: SIEMENS AKTIENGESELLSCHAFT (DE)

( * ) Notice: Subject to any disclaimer, the term of this patent is extended or adjusted under 35 U.S.C. 154(b) by 198 days.

(21) Appl. No.: 14/407,163

(22) PCT Filed: Jun. 14, 2012

(86) PCT No.: PCT/EP2012/061298

§ 371 (c)(1),
(2), (4) Date: Dec. 17, 2014

(87) PCT Pub. No.: WO2013/185824

PCT Pub. Date: Dec. 19, 2013

(65) Prior Publication Data

US 2015/0187539 A1 Jul. 2, 2015

(51) Int. Cl.

| | |
|---|---|
| ***H05G 2/00*** | (2006.01) |
| ***H01J 35/22*** | (2006.01) |
| ***H01J 35/02*** | (2006.01) |
| *H05G 1/08* | (2006.01) |

(52) U.S. Cl.
CPC ..... *H01J 35/22* (2013.01); *H01J 35/025* (2013.01); *H05G 1/08* (2013.01)

(58) Field of Classification Search
CPC ..... H01J 35/00; H01J 35/02; H01J 35/025; H01J 35/22; H01J 35/06; H01J 35/08; H01J 35/16; H01J 2235/087; H05G 1/08; H05G 1/56; H05G 2/00
USPC ..... 378/114, 115, 121, 122, 119
See application file for complete search history.

(56) References Cited

U.S. PATENT DOCUMENTS

| | | | |
|---|---|---|---|
| 656,667 | A | 8/1900 | Schmid |
| 1,283,318 | A | 10/1918 | Ruschmeyer |
| 3,475,646 | A | 10/1969 | Chapman |
| 5,199,054 | A | 3/1993 | Adams et al. |

(Continued)

FOREIGN PATENT DOCUMENTS

| | | | |
|---|---|---|---|
| CN | 1450696 | A | 10/2003 |
| CN | 104412470 | A | 3/2015 |
| DE | 2259382 | B2 | 10/1976 |

(Continued)

OTHER PUBLICATIONS

International Search Report for PCT application No. PCT/EP2012/061298, mailed on Mar. 5, 2013.

(Continued)

*Primary Examiner* — Jurie Yun
(74) *Attorney, Agent, or Firm* — Schmeiser Olsen & Watts LLP

(57) ABSTRACT

A spark gap comprising a cathode and an anode is provided. The spark gap is divided into two partial spark gaps by means of a central piece, namely a high-pressure spark gap and an effective spark gap. The effective spark gap can for example, be used to generate monochromatic x-rays. In order to guarantee a defined switching time, the high pressure spark gap which is initially switched to defined, is used. The switching initiates a potential so high on the centre piece that, when the high pressure spark gap is switched, the effective spark gap can also be switched in a defined manner without significant delays, to a visibly higher voltage.

7 Claims, 1 Drawing Sheet

(56) References Cited

U.S. PATENT DOCUMENTS

2015/0249322 A1 9/2015 Heid

FOREIGN PATENT DOCUMENTS

Figure 1:
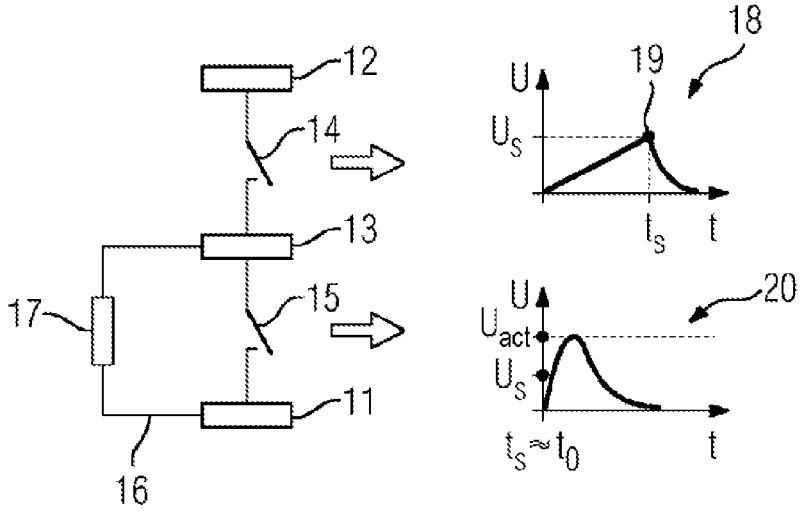

| | | | |
|---|---|---|---|
| EP | 1353422 | A1 | 10/2003 |
| GB | 12 83 318 | | 7/1972 |
| GB | 1283318 | A | 7/1972 |
| GB | 1443048 | A | 7/1976 |
| JP | 2011141956 | A | 7/2011 |
| WO | WO 2013178292 | A1 | 12/2013 |

OTHER PUBLICATIONS

Translation of first Chinese Office Action and Search Report for Chinese Application No. 201280073946.X, Dec. 17, 2015.
Japanese Application No. 2015-516483 Office Action issued on Apr. 28, 2016. 4 pages.
Translation of the Office Action for Chinese Application No. 201280073946X, mailed on Jul. 11, 2016.
German language Grant Decision for DE Applciation No. 2015100885, issued on Jul. 19, 2016.

SPARK GAP

CROSS-REFERENCE TO RELATED APPLICATIONS

This application claims priority to PCT Application No. PCT/EP2012/061298 having a filing date of Jun. 14, 2012, the entire contents of which are hereby incorporated by reference.

FIELD OF TECHNOLOGY

The following relates to a spark gap comprising an anode and a cathode.

BACKGROUND

A spark gap of the type specified at the outset is described, for example, in DE 2 259 382. This is an X-ray radiation source which uses a spark gap for generating X-ray radiation. This spark gap consists of an anode and a cathode, wherein the anode is used as target for generating the X-ray radiation. The X-ray radiation is produced when an arc is struck in the spark gap, which arc excites the target causing it to emit X-ray radiation.

For the application of X-ray radiation, it is desirable if the spark gap has a striking point which is as defined as possible. An aspect relates to specifying a spark gap with which a striking point which is as defined as possible can be implemented.

SUMMARY

This aspect is achieved with the spark gap specified at the outset by virtue of the fact that the spark gap has a high-pressure spark gap and a useful spark gap, which are connected to one another by a central piece. In this case, the spark gap is formed between the cathode and the central piece. The central piece is connected to the anode via a line, in which an electrical resistor is provided. The useful spark gap is formed between the central piece and the anode. This arrangement advantageously enables a very defined striking point, wherein said striking point is ensured by the following striking mechanism. The arrangement of the high-pressure spark gap and the useful spark gap is a series circuit. However, the central piece is connected to the anode via the resistor. In order to strike the useful spark gap, an increasing voltage is applied to the entire arrangement. Since the high-pressure spark gap is filled with a gas which is at a high pressure, a comparatively high flashover potential is ensured here. While the voltage increases, there is still no switching-relevant differential potential present at the useful spark gap since said useful spark gap is connected to the central piece, which at this time is equivalent to a connection to ground. As soon as the comparatively defined switching point of the high-pressure spark gap has been reached, said spark gap is struck. During the flashover in the high-pressure spark gap, an arc then forms, which is equivalent to a low-impedance connection of the cathode to the central piece. Therefore, there is suddenly a potential present at the useful spark gap which is markedly above the required striking potential of the useful spark gap. Said useful spark gap is therefore struck reliably at the defined time owing to the chain reaction that is initiated. By the high-pressure spark gap being struck, the required voltage is available instantaneously (the rate of rise of the voltage-time profile is very high).

In accordance with one configuration of embodiments of the invention, the resistor has a value of 100 to 1000 MΩ and in particular also has an inductance coating. In this case, it is ensured that switching of the useful spark gap takes place since the voltage present, owing to the high resistance, cannot be reduced over the line which connects the central piece to the anode.

In accordance with another configuration of embodiments of the invention, it is provided that the useful spark gap is provided for generating X-ray radiation. The anode is used as target for generating the X-ray radiation. Therefore, the X-ray radiation can be made available at a defined switching time. This is an important precondition for various applications. For example, the X-ray radiation can be used for imaging methods, for example in a flash X-ray radiation source.

In accordance with a particular configuration of embodiments of the invention, it is provided that the anode can be used to generate monochromatic X-ray radiation. If a useful spark gap is used for generating the monochromatic X-ray radiation, a sufficiently high pulse can advantageously be made available for the generation in order that monochromatic X-ray radiation is made available to an extent which is sufficient for the investigation purposes pursued. Monochromatic X-ray radiation can be generated, for example, when a very thin metal film consisting of aluminum or another light metal, for example, is used as target. The lanthanoids can also be used as target material. Within the meaning of the application, light metals are used to denote metals and their alloys which have a density of below 5 $g/cm^3$. Specifically, this definition applies to the following light metals: all alkali metals, all alkaline earth metals apart from radium, in addition scandium, yttrium, titanium and aluminum. Other advantageous material groups for forming the target are tungsten, molybdenum and the group of lanthanoids. Specifically, this is the element lanthanum and the 14 elements following lanthanum in the periodic table.

In order to technically implement an X-ray radiation source, it is advantageous if the useful spark gap is accommodated in an evacuable housing, in which a window transparent to X-ray radiation is also provided, and from which the X-ray radiation can be coupled out. The collector serves the purpose of decelerating electrostatically the electron flow accelerated by the anode and therefore drawing the kinetic energy from it to such an extent that, in the case of impact of the electrons on the collector, the kinetic energy is below the level which is necessary for generating bremsstrahlung. In this way, the parasitic generation of broad-band bremsstrahlung is avoided, which would otherwise be superimposed on the monochromatic, characteristic radiation generated by the anode.

It is furthermore advantageous if the anode, the central piece and the cathode are arranged coaxially. Moreover, it is advantageous if the anode, the central piece and the cathode are formed centrally symmetrically with respect to the common axis. As a result, the formation of inductances which would negatively influence the pulse response of the spark gaps over time (rise time of the pulsed current) is minimized.

BRIEF DESCRIPTION

Figure 2:
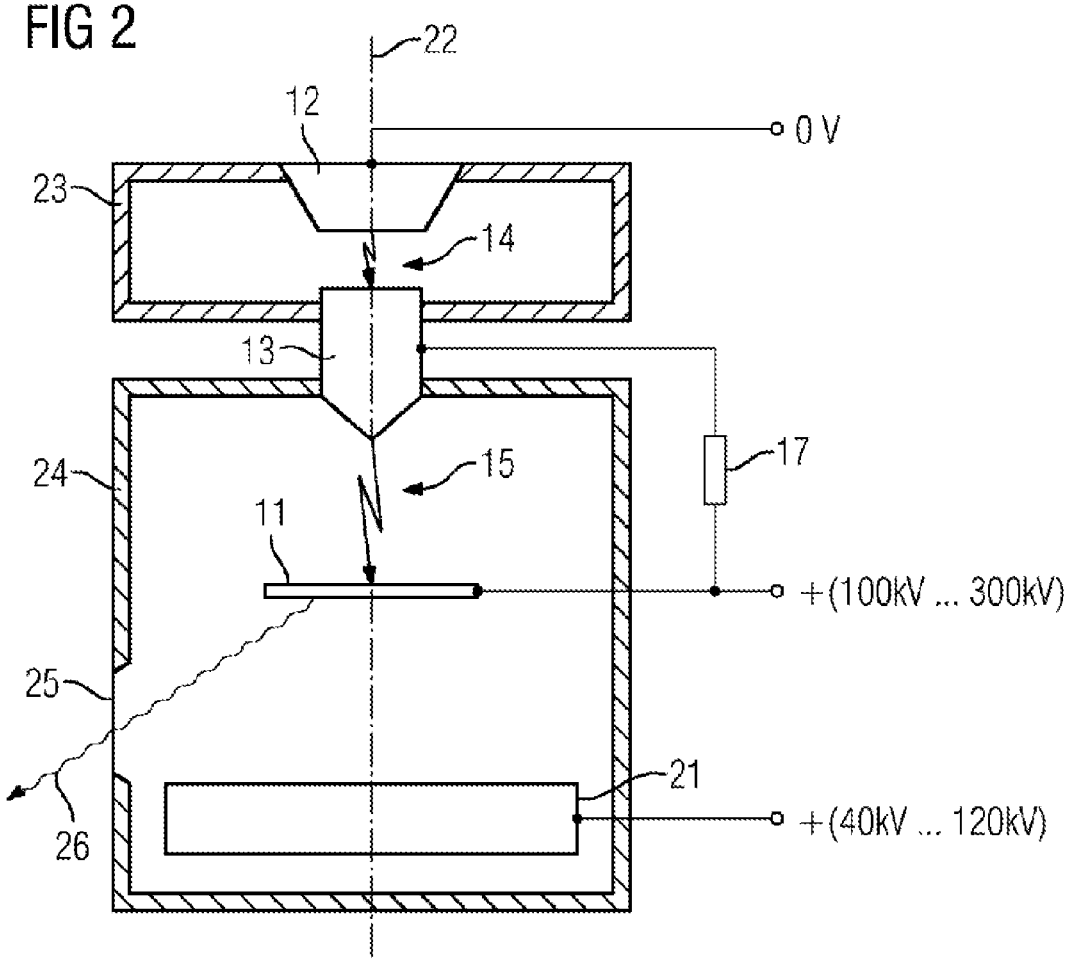

Some of the embodiments will be described in detail, with reference to the following figures, wherein like designations denote like members, wherein:

FIG. 1 shows, schematically, the design of an exemplary embodiment of the spark gap with an illustration of the switching operation without incorporation of the function of the collector; and FIG. 2 shows, schematically, a geometric configuration of the spark gap shown in FIG. 1 in section with an illustration of the collector.

DETAILED DESCRIPTION

FIG. 1 shows the design of the spark gap according to embodiments of the invention. Said spark gap has an anode 11 and a cathode 12. A central piece 13 is connected between the anode 11 and the cathode 12, with the result that two spark gaps, namely a high-pressure spark gap 14 and a useful spark gap 15, are produced. In addition, the central piece 13, which acts as anode for the useful spark gap 15, is connected via a line 16 and the resistor 17 at a high resistance to the anode potential.

For the high-pressure spark gap, for which a gas fill with a high pressure is used, the central piece 13 forms the cathode. Inert gases can be used as fill gases for the high-pressure spark gap. The high-pressure spark gap demonstrates the defined switching response 18, wherein, in the case of a defined voltage rise U with a known rate of rise, the switching point is reached after a defined time t. With the switching point (tS/US), the switching time of the useful spark gap can be predicted comparatively precisely. As already explained, in the case of switching of the high-pressure spark gap, namely the required switching potential for switching the useful spark gap 15 is immediately available. Owing to the low-resistance characteristic of the useful spark gap 15, the central piece 13 has cathode potential at the switching time of the useful spark gap 15. The total voltage between the cathode and the anode is now present at the resistor 17. A current defined by the resistance value of the resistor 17 flows through the resistor. The parasitic inductances of the resistor 17 reduce the system-related current flow through the resistor 17 additionally. Owing to the steep increase in voltage between the central piece 13 and the anode 11, the flashover response of the useful spark gap 15 is positively influenced such that, at the flashover time of the useful spark gap 15, a much higher voltage is present than would be possible owing to conventional striking with a low gradient of the voltage increase. The switching of the useful spark gap 15 at time tS is approximately t0 since the voltage increase is extremely steep owing to the low inductance of the arrangement. The required switching potential US of the useful spark gap 15 is markedly exceeded by the extremely steep voltage gradient. As a result, a voltage which is much higher than the striking voltage is present at the useful spark gap 15 within a very short period of time (nanoseconds). Therefore, a severe flashover through the anode is formed. Owing to this arrangement, the breakdown voltage of the useful spark gap 15 is no longer primarily dependent on US, which is substantially dependent on the geometry and the vacuum, but on the externally applied anode voltage and the corresponding configuration of the high-pressure spark gap 14. The duration of the discharge of the useful spark 15 gap is determined by the capacitance of the arrangement and the energy stored therein and the parasitic inductances in the design.

FIG. 2 shows that the arrangement of the anode 11, the central piece 13, the cathode 12 and a collector 21 is coaxial. In addition, all of these component parts are also centrally symmetrical with respect to the common axis 22 of the coaxial configuration. The high-pressure spark gap is accommodated in a first housing 23, wherein the first housing can be filled with a suitable working gas with the required pressure (filling device not illustrated in any more detail). The useful spark gap 15 is located, together with the collector 21, in a second housing 24, which is evacuated. This second housing also has a window 25, through which X-ray radiation 26 can be coupled out of the housing and can be supplied to an application.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

The invention claimed is:

1. A spark gap comprising:

an anode and a cathode, wherein:

the spark gap has a high-pressure spark gap and a useful spark gap, which are connected to one another by a central piece, the high-pressure spark gap is formed between the cathode and the central piece, wherein the high-pressure spark gap is accommodated in a first housing, wherein the first housing is filled with a working gas, the central piece is connected to the anode via a line, in which an electrical resistor is provided, and the useful spark gap is formed between the central piece and the anode, wherein the useful spark gap is accommodated in a second housing, wherein the second housing is an evacuable housing, in which a collector is also provided, and from which X-ray radiation is coupled out.

2. The spark gap as claimed in claim 1, wherein the resistor has a value of 100 to 1000 MΩ and also has an inductance coating.

3. The spark gap as claimed in claim 2, wherein the useful spark gap is provided for generating X-ray radiation, wherein the anode is used as target for generating the X-ray radiation.

4. The spark gap as claimed in claim 1, wherein the useful spark gap is provided for generating X-ray radiation, wherein the anode is used as target for generating the X-ray radiation.

5. The spark gap as claimed in claim 4, wherein the anode is used to generate monochromatic X-ray radiation.

6. The spark gap as claimed in claim 1, wherein the anode, the central piece and the cathode are arranged coaxially to a common axis.

7. The spark gap as claimed in claim 6, wherein the anode, the central piece and the cathode are formed centrally symmetrically with respect to the common axis.

* * * * *